US007443373B2

(12) United States Patent
Imagawa et al.

(10) Patent No.: US 7,443,373 B2
(45) Date of Patent: Oct. 28, 2008

(54) SEMICONDUCTOR DEVICE AND THE METHOD OF TESTING THE SAME

(75) Inventors: Kengo Imagawa, Fujisawa (JP); Masami Makuuchi, Yokohama (JP); Norio Chujo, Tokyo (JP); Ritsuro Orihashi, Tokyo (JP); Yoshitomo Arai, Ohme (JP)

(73) Assignee: Renesas Technology Corp., Tokyo (JP)

( * ) Notice: Subject to any disclaimer, the term of this patent is extended or adjusted under 35 U.S.C. 154(b) by 511 days.

(21) Appl. No.: 11/002,143

(22) Filed: Dec. 3, 2004

(65) Prior Publication Data

US 2005/0122297 A1 Jun. 9, 2005

(30) Foreign Application Priority Data

Dec. 3, 2003 (JP) ..... 2003-404691
Nov. 24, 2004 (JP) ..... 2004-338903

(51) Int. Cl.
*G09G 3/36* (2006.01)

(52) U.S. Cl. ..... 345/96; 345/87; 365/201

(58) Field of Classification Search ..... 345/87–100, 345/204; 365/201
See application file for complete search history.

(56) References Cited

U.S. PATENT DOCUMENTS 4,881,201 A * 11/1989 Sato et al. ..... 365/185.04
5,402,375 A * 3/1995 Horiguchi et al. ..... 365/189.09
5,528,548 A * 6/1996 Horiguchi et al. ..... 365/226
5,559,744 A 9/1996 Kuriyama et al.
7,098,878 B2 * 8/2006 Udo et al. ..... 345/87
2001/0052898 A1 12/2001 Osame et al.

FOREIGN PATENT DOCUMENTS

JP 10-026655 1/1998
JP 2001-306041 2/2001
JP 2003-107128 4/2003

OTHER PUBLICATIONS

Korean Office Action dated May 26, 2006.

* cited by examiner

*Primary Examiner*—Richard Hjerpe
*Assistant Examiner*—Kimnhung Nguyen
(74) *Attorney, Agent, or Firm*—Antonelli, Terry, Stout & Kraus, LLP.

(57) ABSTRACT

A problem, which one of the inventions included in the present application solves, is to provide a semiconductor device that can simultaneously test a plurality of output pins by less channels of a semiconductor test equipment in number than the integrated output pins of the semiconductor device. Representative one of the inventions has such a configuration that an LCD driver, which is the semiconductor device having a function of driving a gate line of a liquid crystal display panel, comprises: an exclusive-OR circuit for inverting polarities of positive and negative voltages for driving the gate line; a tri-state type inverter circuit capable of changing and controlling, to a high-impedance state, an output circuit for driving the gate line; and at least one of test control terminals TEST for controlling the exclusive-OR circuit and the tri-state type inverter circuit. When a test is conducted, only one terminal of the gate output outputs a positive voltage VGH or negative voltage VGL and the other terminal is set to a high-impedance state, whereby the plurality of gate outputs are simultaneously tested.

12 Claims, 15 Drawing Sheets

*FIG. 4*

| | M | Tir-state type Inverter Circuit 9 | | | |
|---|---|---|---|---|---|
| | | EnH | EnL | Inputted | Outputted |
| Normal Operation | L | L | H | L | VGH |
| | | | | H | VGL |
| Test Mode (1) (Testing p-ch. Transistor) | L | L | L | L | VGH |
| | | | | H | Z |
| Test Mode (2) (Testing n-ch. Transistor) | H | H | H | L | Z |
| | | | | H | VGL |
| Setting Inhibit | H/L | H | L | H/L | Z |

*FIG. 5*

| | TEST | Testing Register | M | EnH | EnL |
|---|---|---|---|---|---|
| Normal Operation | 0 | XXX | L | L | H |
| Test Mode (1) | 1 | 100 | L | L | L |
| Test Mode (2) | 1 | 011 | H | H | H |

*FIG. 6A*

| Counter Output | Gate Signal Outputs | | | | |
|---|---|---|---|---|---|
| | G1 | G2 | G3 | · · · | Gn |
| 1 | + | Z | Z | | Z |
| 2 | Z | + | Z | | Z |
| 3 | Z | Z | + | | Z |
| ⋮ | | | | | |
| n | Z | Z | Z | | + |

+ : Positive Voltage (VGH)
Z : High Impedance

When setting M=L,EnH/EnL=L.

*FIG. 6B*

| Counter Output | Gate Signal Outputs | | | | |
|---|---|---|---|---|---|
| | G1 | G2 | G3 | · · · | Gn |
| 1 | − | Z | Z | | Z |
| 2 | Z | − | Z | | Z |
| 3 | Z | Z | − | | Z |
| ⋮ | | | | | |
| n | Z | Z | Z | | − |

− : Positive Voltage (VGH)
Z : High Impedance

When setting M=H,EnH/EnL=H.

When outputting Voltagae G1.

When outputting Voltage Gx (X=2,3···n) .

| Cp1 | Cp2 |
|---|---|
| X | H |
| H | X |
| ⋮ | ⋮ |

| Counter Output | Gate Signal Outputs | | | | |
|---|---|---|---|---|---|
| | G1 | G2 | G3 | · · · | Gn |
| 1 | + | – | – | | – |
| 2 | – | + | – | | – |
| 3 | – | – | + | | – |
| ⋮ | | | | | |
| n | – | – | – | | + |

+ : Positive Voltage (VGH)
– : Negative Voltage (VGL)

SEMICONDUCTOR DEVICE AND THE METHOD OF TESTING THE SAME

CROSS-REFERENCE TO RELATED APPLICATION

The present application claims priority from Japanese patent application No. JP 2003-404691 filed on Dec. 3, 2003 and No. JP 2004-338903 filed on Nov. 24, 2004, the contents of which are hereby incorporated by reference into this application.

BACKGROUND OF THE INVENTION

The present invention relates to a semiconductor device and a testing method thereof and, especially, to a technique effectively applied to both of a semiconductor device such as a LCD driver having a function of driving gate lines of a liquid crystal display panel and a testing method thereof.

Techniques that the inventors of the present invention have examined on the premise of the present invention will be described using FIGS. 16 to 19. FIG. 16 is a view showing a connection relation between a liquid crystal display panel and a LCD driver; FIG. 17 is a view showing a connection relation between a LCD driver and a semiconductor test equipment; FIG. 18 is a view showing a configuration of the inverter circuit 30 in FIG. 17; and FIG. 19 is a view showing an operation of a gate output of a LCD driver.

As shown in FIG. 16, a liquid crystal display panel 500 and a LCD driver for driving the liquid crystal display panel 500 are connected. A transistor 511 and a capacitor 512 are disposed in each pixel 510 of the liquid crystal display panel 500 in the form of this Figure. A source terminal of each of the transistors arranged vertically in Figure is used in common. Similarly, a gate terminal of each of the transistors arranged horizontally in Figure is also used in common.

Generally, in order to drive the liquid crystal display panel 500, there are required: a source driver 501 connected to a source common terminal and having a function of applying a gray-scale voltage acting as color display information; a gate driver 502 connected a gate common terminal and having a function of executing display control of horizontal pixels shown in Figure; and a power supply circuit 503 having a function of generating a voltage required to drive the source driver 501 and the gate driver 502. These are generally called a LCD driver, wherein the source driver 501, the gate driver 502, and the power supply circuit 503 may be individually integrated or may be integrated on one chip by consolidating the several functions.

As shown in FIG. 17, when an electrical operation test is conducted, an LCD driver (gate driver with a built-in power supply circuit) if which has a function of driving the gate common terminal of the liquid crystal display panel and a semiconductor test equipment 100 are connected. Under this connection state, the electrical operation test is started. Each of inverter circuits (output circuit) 30 that are the output stages of the LCD driver 1*f* comprises a level shift circuit 40, a p-channel transistor 50, and an n-channel transistor 51, as shown in FIG. 18, wherein a positive voltage VGH or negative voltage VGL is outputted from a gate output terminal Gx in accordance with an input level H/L.

Gate output terminals G1 to Gn of the LCD driver 1*f* execute control of display/non-display per line (one pixel line in a horizontal direction as shown in FIG. 16) of the liquid crystal display panel in FIG. 17. Therefore, even if a counter value (setting state) of the LCD driver 1*f* is changed as shown in FIG. 19, the plurality of gate output terminals G1 to Gn operate so as to exclusively output such a voltage that one terminal among them surely outputs a positive voltage VGH (display voltage) and each of the other terminals outputs a negative voltage VGL (non-display voltage).

In the above-described test for the LCD driver 1*f*, as shown in FIG. 17, each of the gate output terminals G1 to Gn is connected to a comparator 103 of the semiconductor test equipment 100, and the semiconductor test equipment 100 determines whether a voltage value of each of the gate output terminals G1 to Gn is a positive voltage VGH or negative voltage VGL. Then, if the LCD driver 1*f* outputs the illustrated voltage values from the respective output terminals G1 to Gn in all counter-value states (setting states) shown in FIG. 19, it is determined that a function of executing the gate outputs in the LCD driver 1*f* is not abnormal, whereby the test for the gate outputs is completed.

Meanwhile, as high-definition liquid crystal display panels are developed and improved, there is the indication of increasing the number of output pins of the LCD driver. The conventional testing method for the LCD driver is performed by respectively connecting the gate output terminals to the comparators of the semiconductor test equipment, as described above. Further, some of the number of input pins must be allocated the number of channels of the semiconductor test equipment because a voltage from the semiconductor test equipment is applied also to the input pins for operating the LCD driver. Thus, the semiconductor test equipment having more channels in number than the input/output pins of the LCD driver is required and, for example, the semiconductor test equipment having 256 channels cannot test the LCD driver in which the number of gate outputs is 350 pins. Therefore, there is the problem that the above semiconductor test equipment cannot be used for test.

Further, in the LCD driver for driving the liquid crystal display panel which is installed in a small item such as a portable phone, in order to further downsize such a item, a trend is such that all functions (source, gate, and power supply circuit, etc.) for driving the liquid crystal display panel are integrated on one chip, and so the total number of pins of the LCD driver is increased. Therefore, it is necessary to increase the number of channels of the semiconductor test equipment, by newly purchasing an expensive semiconductor test equipment having a large number of channels and by buying options etc. sold through manufacturers. Accordingly, there is the problem that production cost for LCD driver cannot be reduced.

As a solution of the above-described problems, a technique for providing a change-over switch between an element to be tested and a semiconductor test equipment is disclosed in, for example, Patent Document 1 (Japanese Patent Laid-open No. 10-26655). Specifically, it discloses that the test is conducted while the change-over switch sequentially switches each connection between the comparators in the semiconductor test equipment and the output pins of the semiconductor device in accordance with switching signals outputted from a CPU in the semiconductor test equipment. Thereby, even if the output pins of the semiconductor device is more in number than the channels of the semiconductor test equipment, the test can be conducted.

SUMMARY OF THE INVENTION

However, if the semiconductor device having the output pins more in number than the channels of the semiconductor test equipment is tested by using the technique disclosed in Patent Document 1, a test time is increased in comparison with a conventional technique because the test is conducted while the respective connections are sequentially switched. This causes an increase in production costs. For example, if 10 channels of the semiconductor test equipment are used by employing the technique of the Patent Document 1 at a time of testing the gate outputs of the LCD driver having, e.g., the gate inputs of 350 pins, 35 times as long as a conventional test time is required. Therefore, there arises the problem that the production cost of the semiconductor device cannot be reduced.

Accordingly, in view of the above-described problems, an object of the present invention is to provide a semiconductor device which can simultaneously test a plurality of output pins by integrating them and making the channels of the semiconductor test equipment less in number than the output pins in the semiconductor device, and to provide a method of testing the same. Especially, an object of the present invention is to provide a semiconductor device effectively applicable to a LCD driver having a function of driving gate lines of a liquid crystal display panel and to provide a method of testing the same.

Outlines of representative ones of inventions disclosed in the present application will be briefly described as follows.

That is, the present invention is applied to a semiconductor device having a function of driving a gate line of a liquid crystal display panel, and comprises: a polarity inverting circuit for inverting polarities of a positive voltage and a negative voltage for driving the gate line; a state setting circuit capable of changing and controlling, to a high-impedance state, an output circuit for driving the gate line; and at least one control terminal for controlling states of the polarity inverting circuit and the state setting circuit.

Also, the present invention is applied to the semiconductor device having a function of driving a gate line of a liquid crystal display panel, and comprises: a polarity inverting circuit for inverting polarities of a positive voltage and a negative voltage for driving the gate line; a transistor capable of changing and controlling, to a high-impedance state, an output circuit for driving the gate line; and at least one control terminal for controlling states of the polarity inverting circuit and the transistor.

Further, the present invention is applied to a method of testing a semiconductor device having a function of driving a gate line of a liquid crystal display panel, and comprises the steps of: changing and controlling, to a positive voltage output and a high-impedance state or to a negative voltage output and a high-impedance state, outputs of a plurality of output terminals for driving the gate line; and conducting a test of the plurality of output terminals of the semiconductor device, through a resistor network provided inside or outside the semiconductor device, by less channels of a semiconductor test equipment in number than the output terminals of the semiconductor device.

Effects of representative one of inventions disclosed in the present application will be briefly described as follows.

(1) The plurality of output pins can be simultaneously tested by less channels of the semiconductor test equipment in number than the output pins of the semiconductor device.

(2) The semiconductor test equipment having the number of channels less than the total number of pins of the semiconductor device can be effectively utilized.

BRIEF DESCRIPTION OF THE DRAWINGS

FIG. 4 is a view showing a setting state of control signals in a first embodiment.

FIG. 5 is a truth table of a test control circuit in a first embodiment.

FIG. 6A is a view showing an operation at a time of testing in a first embodiment and corresponds to test mode (1).

FIG. 6B is a view showing an operation at a time of testing in a first embodiment and corresponds to test mode (2).

DESCRIPTION OF THE PREFERRED EMBODIMENTS

Figure 1:
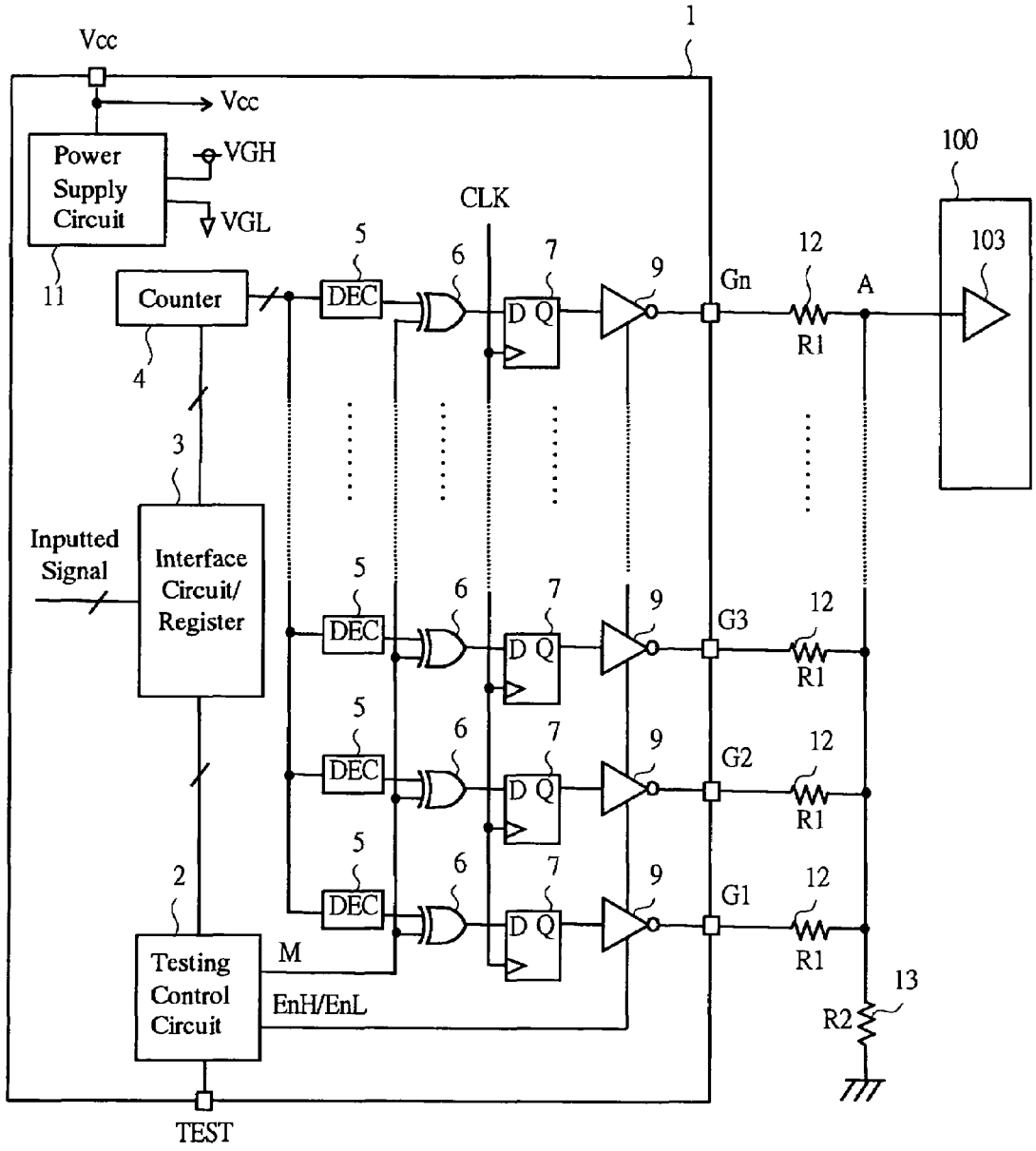
FIG. 1 is a view showing a configuration of an LCD driver of a first embodiment.

Hereinafter, embodiments of the present invention will be detailed based on the drawings. Note that members having the same function are denoted in principle by the same reference numeral throughout all the drawings for explaining the embodiments and the repetitive description thereof will he omitted.

First Embodiment

Figure 2:
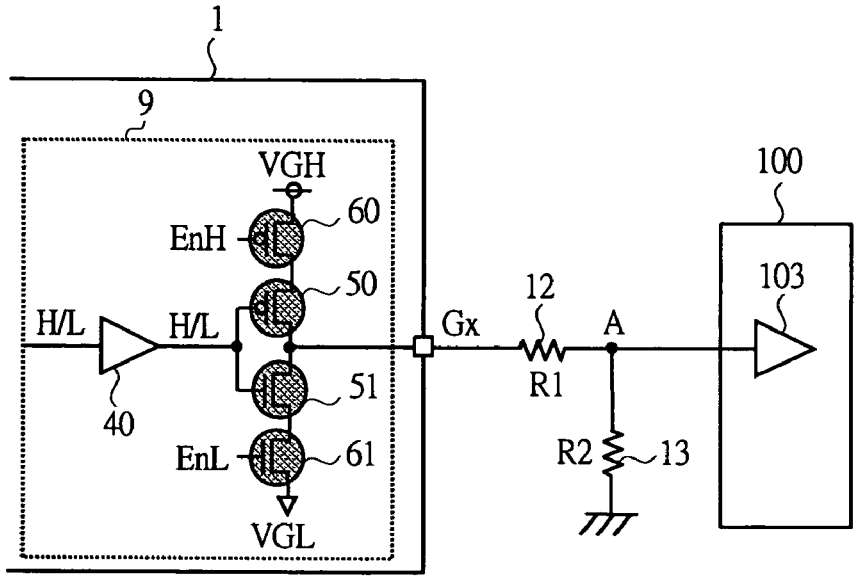
FIG. 2 is a view showing an equivalent circuit at a time of testing in a first embodiment.
Figure 3:
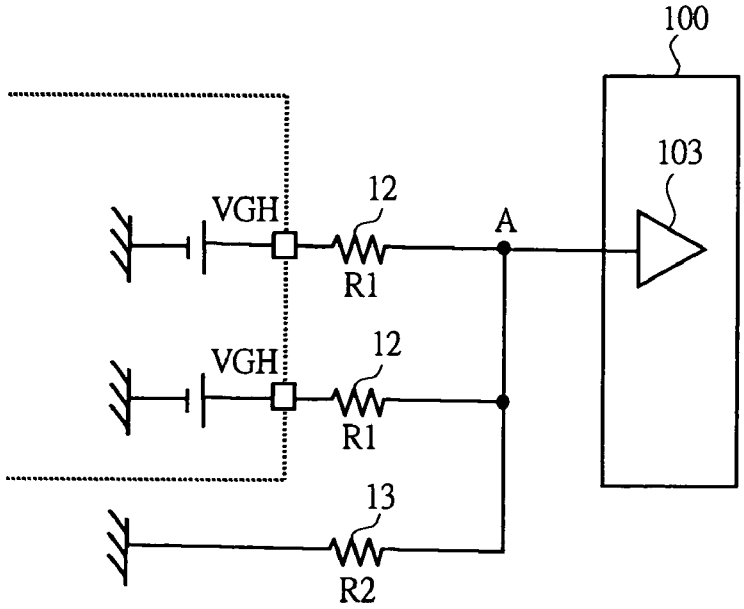
FIG. 3 is a view showing an equivalent circuit at a time of assuming occurrence of failure in a first embodiment.
Figure 7:
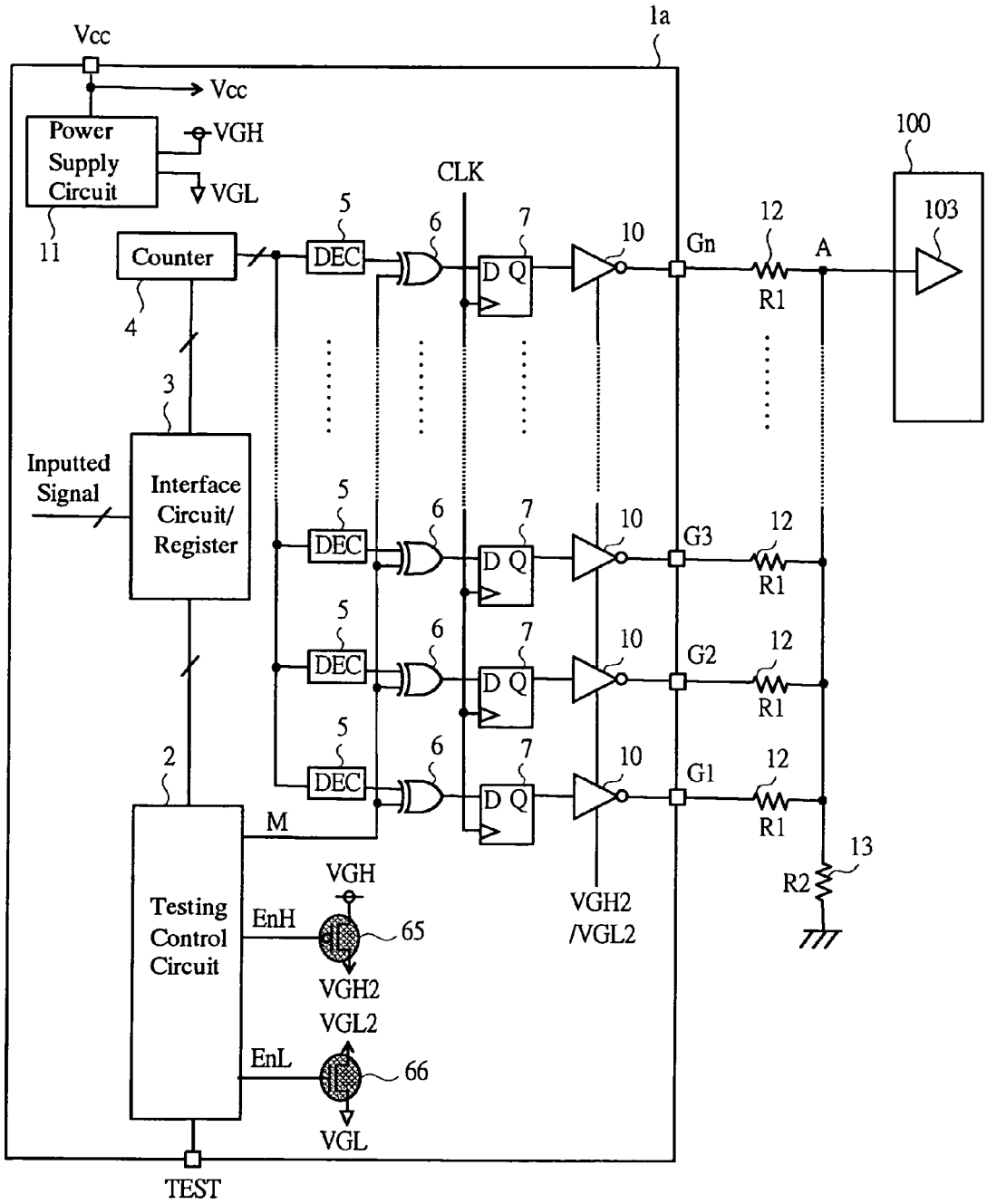
FIG. 7 is a view showing a configuration example of an LCD driver having a small circuit scale in a first embodiment.
Figure 8:
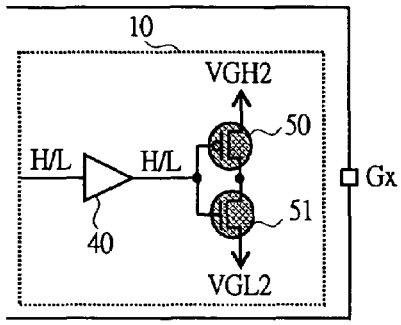
FIG. 8 is a view showing a circuit configuration of the inverter circuit in FIG. 7 in a first embodiment.

An LCD driver that is a first embodiment of a semiconductor device according to the present invention will be described using FIGS. 1 to 8. FIG. 1 is a view showing a configuration of an LCD driver; FIG. 2 is a view showing an equivalent circuit at a time of testing; FIG. 3 is a view showing an equivalent circuit at a time of assuming occurrence of failure; FIG. 4 is a view showing a setting state of a control signal;

FIG. 5 is a view showing one example of a truth table of a test control circuit; FIG. 6 is a view showing an operation at a time of testing; FIG. 7 is a view showing a configuration example of an LCD driver having a small circuit scale; FIG. 8 is a view showing a circuit configuration of the inverter circuit in FIG. 7.

Figure 16:
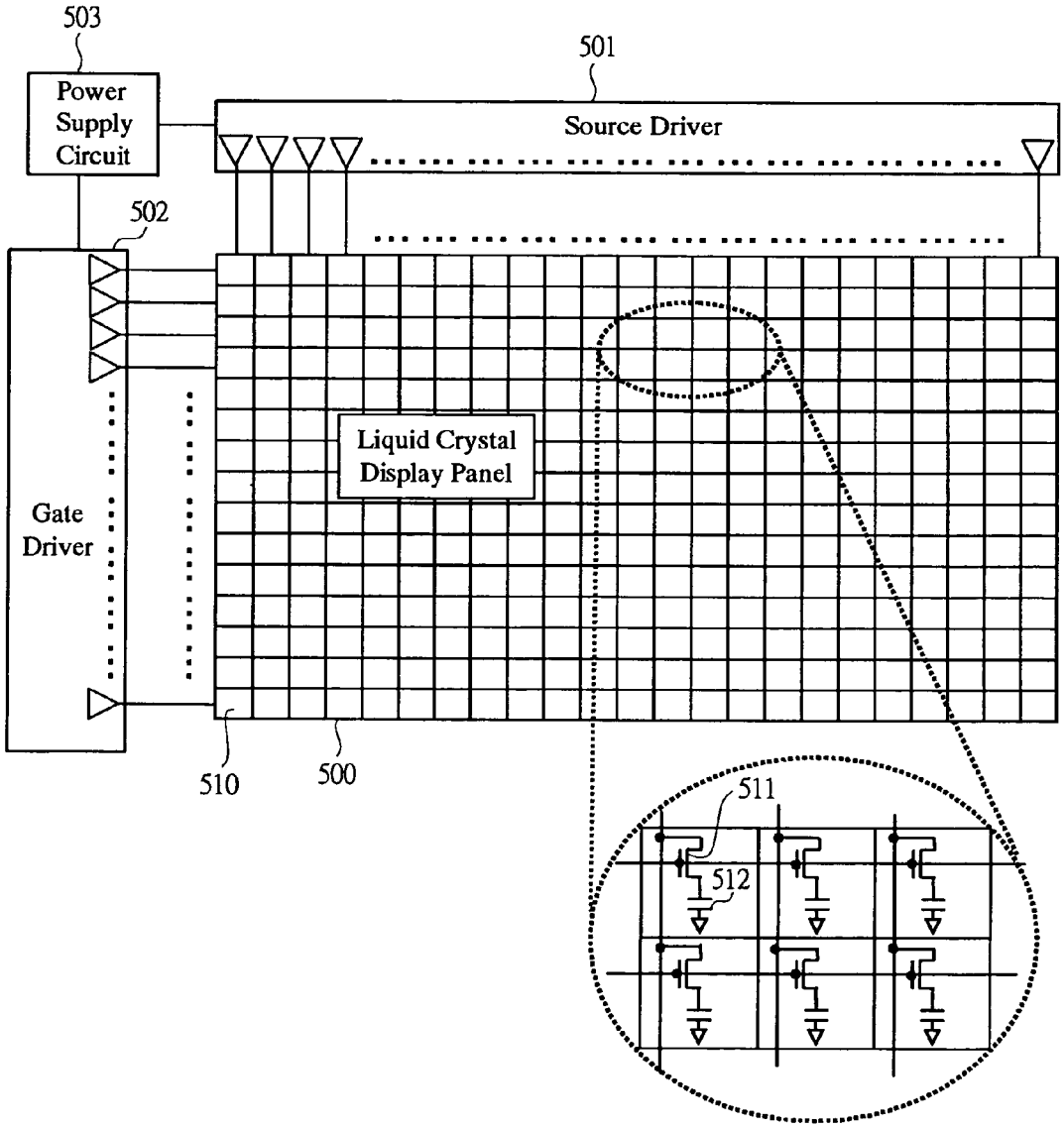
FIG. 16 is a view showing a relation of connection between a liquid crystal display panel and an LCD driver in a technique examined as the premise of the present invention.
Figure 17:
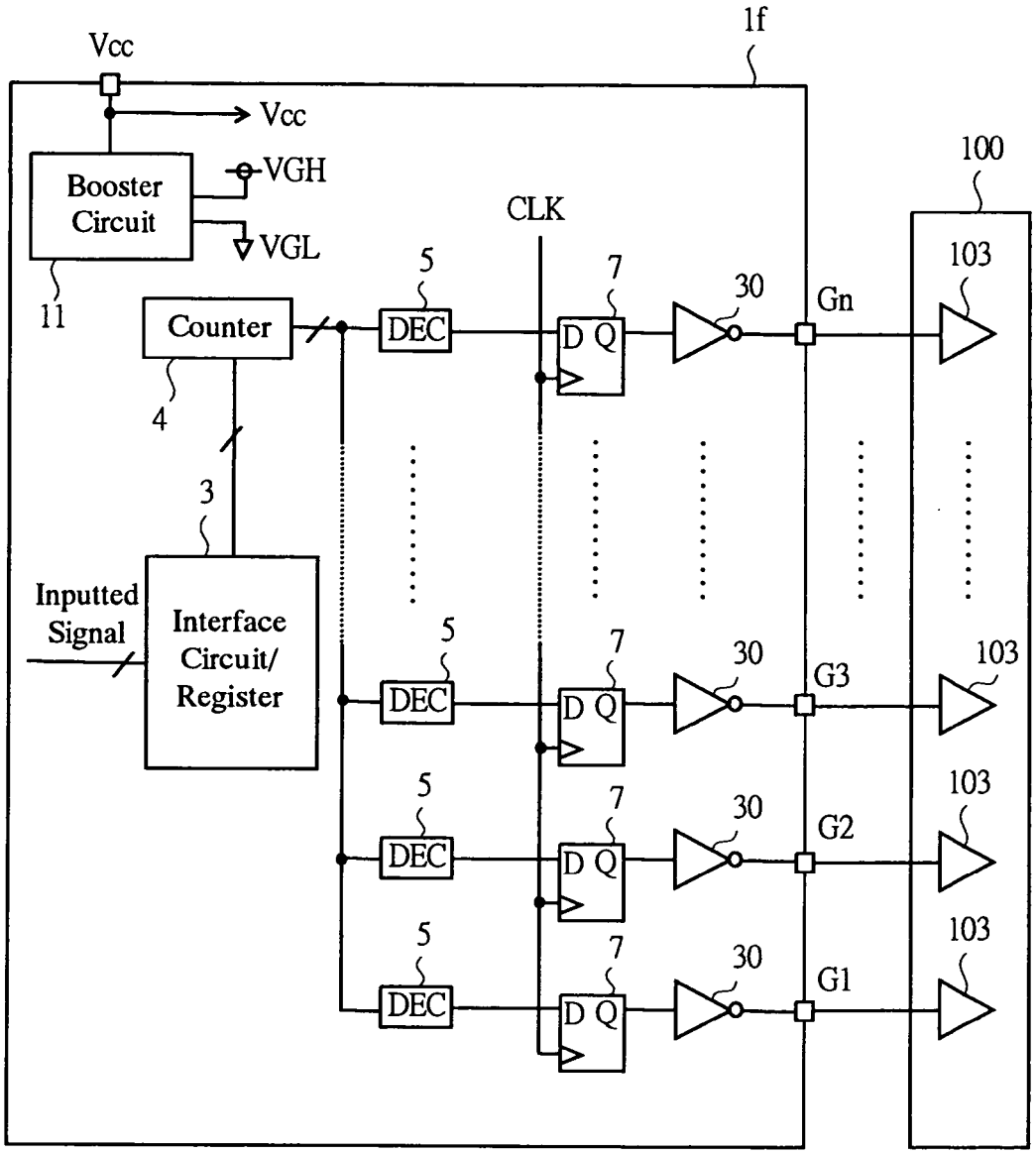
FIG. 17 is a view showing a relation of connection between an LCD driver and a semiconductor test equipment in a technique examined as the premise of the present invention.
Figures 18, 19:
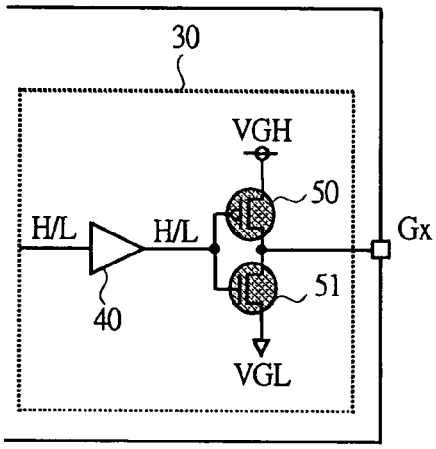
FIG. 18 is a view showing a configuration of the inverter circuit in FIG. 17 in a technique examined as the premise of the present invention.
FIG. 19 is a view showing an operation of gate outputs of an LCD driver in a technique examined as the premise of the present invention.

A LCD driver of a first embodiment is, as shown in FIG. 16 as described above, applied to the gate driver which is connected to the gate common terminal and has a function of executing the display control of the horizontal pixels, among the source driver, the gate driver, and the power supply circuit that are required to drive the liquid crystal display panel. The LCD driver shown in FIG. 16 is different from that as shown in FIG. 17 in that: an output of the inverter circuit at an output stage is replaced with a tri-state type inverter circuit (state setting circuit) 9 which can change to a high-impedance state; an exclusive-OR circuit (polarity inverting circuit) 6 is provided between the decoder circuit 5 and the latching circuit 7; and the test control circuit (control circuit) 2 and the test control terminal (control terminal) TEST are provided to control the tri-state type inverter circuits 9 and the exclusive-OR circuits 6, as shown in FIG. 1.

Therefore, although being detailed later, the LCD driver of this embodiment can simultaneously test the plurality of gate outputs by the less channels of the semiconductor test equipment in number than the gate inputs at a time of the testing by the semiconductor test equipment since only one terminal of the gate outputs is an input of a positive voltage VGH or negative voltage VGL and the other terminals are set to high-impedance states to integrate the plurality of gate inputs through the resistor network.

In other words, the LDC driver 1 of the first embodiment is configured by: the test control circuit 2 connected to the test control terminal TEST; the interface circuit/resistor 3 that is connected to the test control circuit 2 and to which input signals are inputted; the counter 4 connected to the interface circuit/resistor 3; the plurality of decoder circuits (DEC) 5 connected in parallel with the counter 4; the plurality of exclusive-OR circuits 6 that are connected respectively to the decoder circuits 5 and to which an inputted signal "M" from the test control circuit 2 is outputted; the plurality of latching circuits 7 connected respectively to the exclusive-OR circuits 6 and each synchronizing with a clock signal CLK; the plurality of tri-state type inverter circuits 9 connected respectively to the latching circuits 7 and controlled by a setting signal EnH/EnL from the test control circuit 2; the power supply circuit 11 connected to the power supply terminal Vcc and generating a positive voltage VGH and a negative voltage VGL; and the like.

In the LCD driver 1, the input signal includes information to be transferred to the pixel display in the next line on the liquid crystal display panel. By depending on whether respective functions of driving the liquid crystal display panel are integrated on one chip or on different chips, there are two cases where the input signals are inputted from the internal circuit and where the input signals are inputted from the external circuit. The input signals are inputted through the interface circuit/resistor 3 into the counter 4, wherein a value for the counter 4 is incremented in accordance with the change of the input signals and is outputted to the decoder circuit 5. At this time, the decoder circuit 5 outputs the input signals through the exclusive-OR circuits 6, the latching circuits 7, and the tri-state type inverter circuits 9 in accordance with the value of the counter 4 so that the voltage of each of the gate output terminals G1 to Gn is VGH/VGL (input level L/H) in the normal operation (FIG. 4). On the normal operation, the signal "M" from the test control circuit 2 is "L" (Low level), a signal "EnH" is "L", and a signal "EnL" is "H" (High level). The operation in the test mode will be described later.

The exclusive-OR circuit 6 is a polarity inverting circuit for inverting polarities of a positive voltage and a negative voltage that drive the gate lines of the liquid crystal display panel. The tri-state type inverter circuit 9 is a state setting circuit, which can change and control, to a high-impedance state, the output circuit for driving the gate lines. Note that the latching circuit (D-flip-flop circuit) is provided in order to hold the output value for the decoder circuit 5 during a displaying period of the pixels per line in the liquid crystal display panel.

The tri-state type inverter circuit 9 has a so-called clocked inverter circuit configuration, and comprises a level shift circuit 40, p-channel transistors having high voltage-tolerance 50 and 60, and n-channel transistors having high voltage-tolerance 51 and 61 which configure a conventional inverter circuit, as shown in FIG. 2. The tri-state type inverter circuit 9 can be changed and controlled to a high-impedance state in accordance with the input level H/L as shown in FIG. 4 by inputting the H/L signals to the gate terminals (EnH/EnL) of the transistors 60 and 61.

Note that the purpose for using the level shift circuit 40 and the high voltage-tolerant transistor (described as the high-voltage transistor hereinafter) is as follows. That is, the gate output voltages VGH/VGL are significantly higher than the power supply voltage Vcc such as +16.5/−16.5 V for driving the LCD driver 1 and so the p-channel transistors 50 and 60 and the n-channel transistors 51 and 61 must be the high-voltage transistors which can assures the operation thereof even if a potential difference between the voltages VGH and VGL, i.e., a voltage of 33 V (voltage normally higher than it) is applied.

The transistors 50 and 60, and 51 and 61 surrounded by the circles as shown in FIG. 2 indicate the use of the high-voltage transistors. Each high-voltage transistor is larger in size than the conventional transistor which can assure the operation thereof by applying the normal power supply voltage. Therefore, as shown in FIG. 2, by providing the level shift circuit 40, using the normal transistor at a previous stage of the level shift circuit 40, and using the high-voltage transistor at a subsequent stage of the level shift circuit 40, a chip area of the LCD driver 1 is downsized.

When the test is conducted, the setting signals to the tri-state type inverter circuits 9 are set to "EnH=EnL=L" as shown in test mode (1) of FIG. 4. At this time, if the input signals of the exclusive-OR circuits 6 are set to "M=L", the output level of the decoder circuit 5 is not changed and the input signals are inputted into the try-state type inverter circuits 9 through the latching circuits 7. Thereby, in the above-mentioned setting state, a portion to output the negative voltage VGH by the normal operation can be changed to a high-impedance state, as shown in FIG. 6A. Note that a method of setting the setting signal EnH/EnL to the tri-state type inverter circuits 9 and setting the signal "M" to the exclusive-OR circuits 6 will be detailed later.

The LCD driver is set to the above-described test mode; as shown in FIG. 1, one ends of first resistors (R1) 12 are connected to the output terminals G1 to Gn, respectively; the other ends of the first resistors 12 are commonly connected; and the resistor network which is terminated on a second resistor (R2) 13 at a common connecting point "A" is provided. Then, the connecting point "A" is connected to the comparator 103 in the semiconductor test equipment 100 to conduct the test. If no failure exists in the LCD driver, the only one terminal of the gate outputs is an output of the voltage VGH and the other terminals are each in a high-impedance state regardless of values of the counter 4, as shown in FIG.

6A. Therefore, the equivalent circuit as shown in FIG. 2 is obtained. In other words, the inputted voltage of the comparator 103 becomes a ratio between a resistance value R1 of the resistor 12 and a resistance value R2 of the resistor 13, i.e., $$VA=\{R2/(R1+R2)\}\times VGH[V] \quad \text{(formula 1)}$$

and if the resistance values of the first resistor 12 and the second resistor 13 are equivalent (R1=R2=R), $$VA=(1/2)VGH[V].$$

Unlike the output voltage state as shown in FIG. 6A due to failure of the decoder circuit 5 etc., if a positive voltage VGH is outputted to two or more gate outputs or a voltage is not outputted to all the gate outputs, a voltage value other than the above-described voltage is inputted to the comparator 103 through the resistor network as shown in FIG. 1. If the positive voltage VGH is inputted into two terminals among the gate outputs due to the failure, for example, the equivalent circuit as shown in FIG. 3 is obtained. At this time, the voltage inputted into the comparator 103 at the connecting point "A" is represented as follows by using the Millman's theorem, $$VA=(2VGH/R1)/\{(1/R1)+(1/R1)+(1/R2)\}[V] \quad \text{(formula 2).}$$

If the resistance values of the first resistor 12 and the second resistor 13 are equivalent (R1=R2=R), $$VA=(2/3)VGH[V]$$

and so whether any failure exists is determined in accordance with the voltage value at the connecting point "A".

In the above-described test, essentially at a time of outputting a negative voltage VGL, the setting signal to the tri-state type inverter circuit 9 is set to "EnH=EnL=L" to change to a high-impedance state. If such a test is conducted, the n-channel transistor 50 as shown in FIG. 2 does not usually operate. Therefore, in order to conduct the operation test of the n-channel transistor 50, the signal "M" inputted into the exclusive-OR circuit 6 is set to the H level and the levels of the H/L signals inputted into the tri-state type inverter circuit 9 are inverted. Then, if the setting signals to the tri-state type inverter circuit 9 are set to "EnH=EnL=H" as shown in test mode (2) of FIG. 4, the only one terminal among the gate outputs becomes an output of the voltage VGL as shown in FIG. 6B. Thereby, the voltage inputted into the comparator 103 at the connecting point "A" is equal to the value obtained by a change from the voltage VGH to VGL in the above-described formula 1 and formula 2, so that whether any failure exists therein can be determined similarly.

Thus, the polarity inverting signal "M" to the exclusive-OR circuit 6 and the setting signals EnH and EnL to the tri-state type inverter circuit 9 are set as shown in the test modes (1) and (2) of FIG. 4, and so a plurality of gate outputs can be simultaneously tested by one channel of the semiconductor test equipment.

Next, the settings of the signal "M" to the exclusive-OR circuit 6 and the signals EnH and EnL to the tri-state type inverter 9 will be described. FIG. 1 shows a circuit configuration in which the signals M, EnH, and EnL are generated by the test control circuit 2. Specifically, a test resistor (not shown) and the test control terminal TEST are prepared in the interface circuit/resistor 3. A write operation to the test resistor is performed by using an input-signal line. The test control terminal TEST is used as a control terminal for selecting a normal operation/test mode. The test control circuit 2 may, for example as shown in FIG. 5, have such a circuit configuration that the signals M, EnH, and EnL are outputted in accordance with the setting values of the test control terminal and the test resistor.

Note that a correlation between each of the setting values of the test control terminal TEST and the test resistor and each of the signals M, EnH, and EnL is, as shown in FIG. 5, one example and is not limited to this case. Although the test control circuit 2 is individually illustrated, it may be included in the interface circuit/resistor 3 for example. Additionally, although the second resistor 13 is terminated on GND (ground), it may be terminated on an arbitrary voltage.

In this embodiment, one example in which the signals (M, EnH and EnL) for switching the test modes are generated in the test control circuit 2 in accordance with the setting values of the test control terminal TEST and the test resistor has been described with reference to the Figures. However, an object of the present invention is that the output states as shown in FIG. 6 (test modes (1) and (2)) are set at a time of conducting the test and then the test is started. Therefore, it is not intended to limit the circuit configuration for generating the signals for switching the test modes, and the circuit configuration may be variously modified and altered. For example, by providing the control terminals for the signals M, EnH and EnL, the H/L levels may be switched and controlled from the outside.

As apparent from the foregoing description, the exclusive-OR circuit 6 is provided in order to invert the input level to the tri-state type inverter circuit 9. Therefore, so long as the input/output levels are inverted by the signal "M", circuit configurations other than that of the exclusive-OR circuit 6 may be used. Although the Figure is shown to include the power supply circuit 11 for generating the gate output voltages VGH/VGL from the power supply voltage Vcc, there may be used a configuration in which the power supply circuit is included depending on the kind of LCD driver or which the gate output voltages VGH/VGL are inputted from the outside.

Also, FIG. 1 shows one configuration example of the LCD driver relating to the gate outputs and therefore is not limited to the illustrated configuration. Any circuit having functions not shown in the Figure may be integrated on the same chip. Further, although the level shift circuit is included in the tri-state type inverter circuit 9 in FIG. 2, it is not necessarily to provide the level shift circuit in the same circuit.

In the present embodiment, all the gate outputs of the LCD driver have been illustrated and described to be simultaneously tested using one channel of the semiconductor test equipment. However, the present invention is not limited to this case and can conduct the test by integrating the plurality of gate outputs through the resistor network and by using less channels of the semiconductor test equipment in number than the gate outputs. The integrated number of gate outputs and the used number of channels of the semiconductor test equipment may be determined in view of: a relation between the number of input/output pins in the LCD driver and the total number of channels of the semiconductor test equipment to be used; arrangement of the gate output pins on the chip; and the like.

In the following embodiments, the above description will be omitted. However, it is evident that the above description is common to all the embodiments of the present invention.

Finally, a method of reducing a chip-occupied area of an additional circuit will be described in this embodiment. The configuration of the tri-state type inverter circuit 9 as shown in FIG. 1 is achieved in combination with the transistors as shown in FIG. 2. However, as having already been described, the transistors to be used for the tri-state type inverter circuit 9 must be high-voltage transistors. Therefore, the p-channel and n-channel high-voltage transistors are required to be provided up to the number of respective gate output terminals in comparison with the LCD driver premised on the present invention, so that the chip area is increased and it becomes difficult to reduce the price of the LCD driver.

For this reason, as shown in FIGS. 7 and 8, in the LCD driver 1*a* having a small circuit scale by way of example, the transistors 65 and 66 for being changed and controlled to the high-impedance states are separately provided from the tri-state type inverter circuit 10, and the voltages VGH2 and VGL2 of the transistors 65 and 66 are distributed into the respective tri-sate type inverter circuits 10. Therefore, the same operation as that of the circuit as shown in FIGS. 1 and 2 can be performed. The added number of high-voltage transistors is less than the case as shown in FIGS. 1 and 2 by being changed to the configuration as shown in FIGS. 7 and 8, whereby it is possible to reduce an influence on an increase in the chip area of the LCD driver to be applied to the present invention.

Although the transistors 65 and 66 for being changed and controlled to the high-impedance states are separately disposed from the other circuits in FIG. 7, they may be included in the test control circuit 2 and/or the power supply circuit 11. Additionally, although each of the transistors 65 and 66 is illustrated as a transistor, it may be variously modified so that a plurality of transistors are provided in parallel in view of current limit and a resistance value of each transistor, i.e., so that an optimum setting system can be configured.

In the following embodiments, the use of the tri-state type inverter circuit as shown in FIGS. 1 and 2 is illustrated and described. However, needless to say, the above circuit may be changed to the circuit configuration as shown in FIGS. 7 and 8.

Second Embodiment

Figure 9:
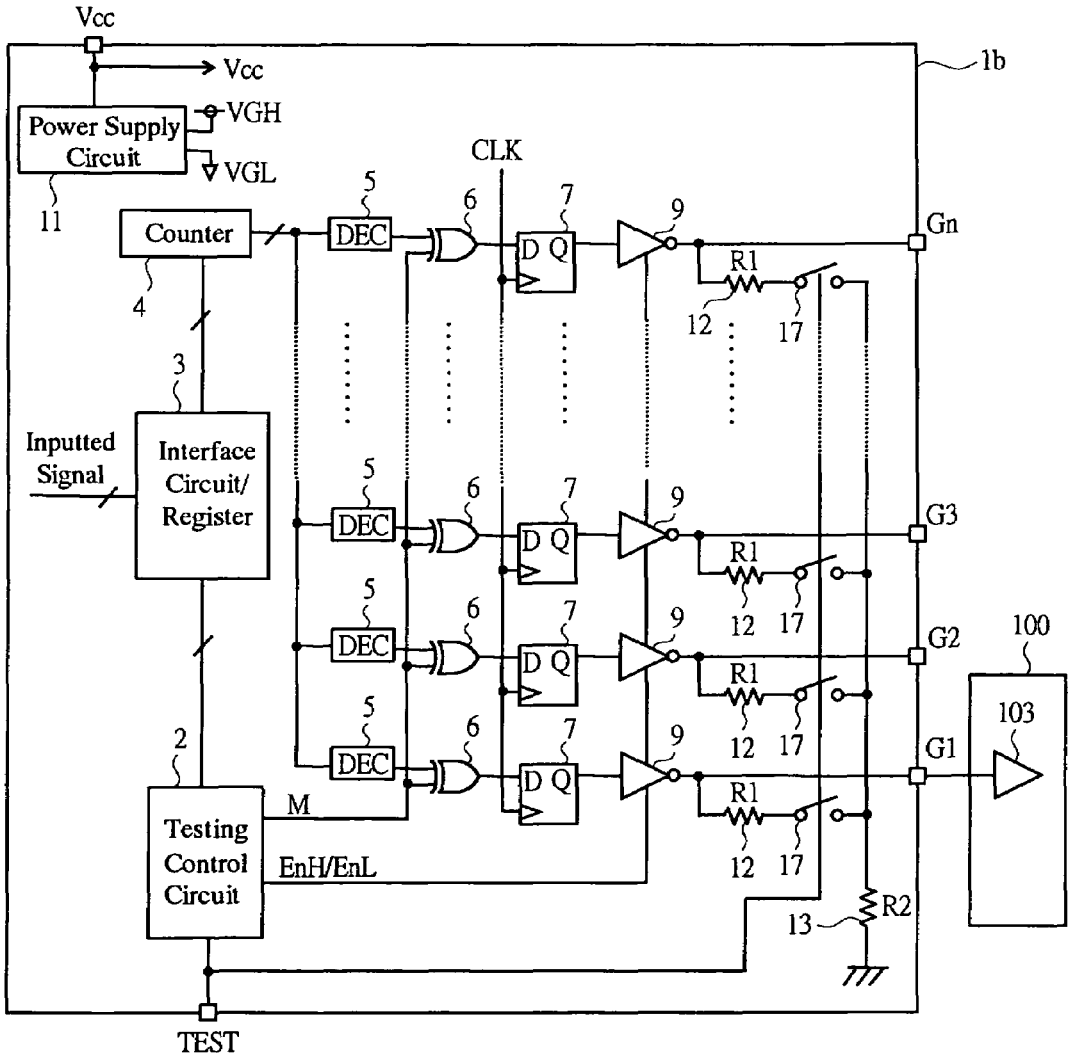
FIG. 9 is a view showing a configuration of an LCD driver in a second embodiment.

An LCD driver, which is a second embodiment of a semiconductor device according to the present invention, will be described using FIGS. 9 to 12. FIG. 9 is a view showing a configuration of an LCD driver; FIG. 10 is a view showing an equivalent circuit at s time of testing; FIG. 11 is a view showing a configuration example of an LCD driver in which resetting of a reference voltage is not required; and FIG. 12 is a view showing a test pattern.

An LCD driver 1*b* of this embodiment represents, as shown in FIG. 9, one example in which the resistor network provided between the LCD driver and the semiconductor test equipment in the first embodiment is integrated into the LCD driver. It is provided with a switch (switch means) 17 which is connected to the first resistor 12 in series so as to separate the resistor network at a time of conducting no test. The description of setting each gate output voltage, each of the signals M, EnH, and EnL at the time of the testing (test modes) is omitted because it is the same as that in the first embodiment. The difference between the first and second embodiments is that, by integrating the resistor network into the LCD driver 1*b*, all the output voltages at the time of the testing are inputted into the comparator of the semiconductor test equipment 100 through the gate output terminal G1 and are determined. Additionally, the above difference is the output voltage value thereof.

Figure 10A:
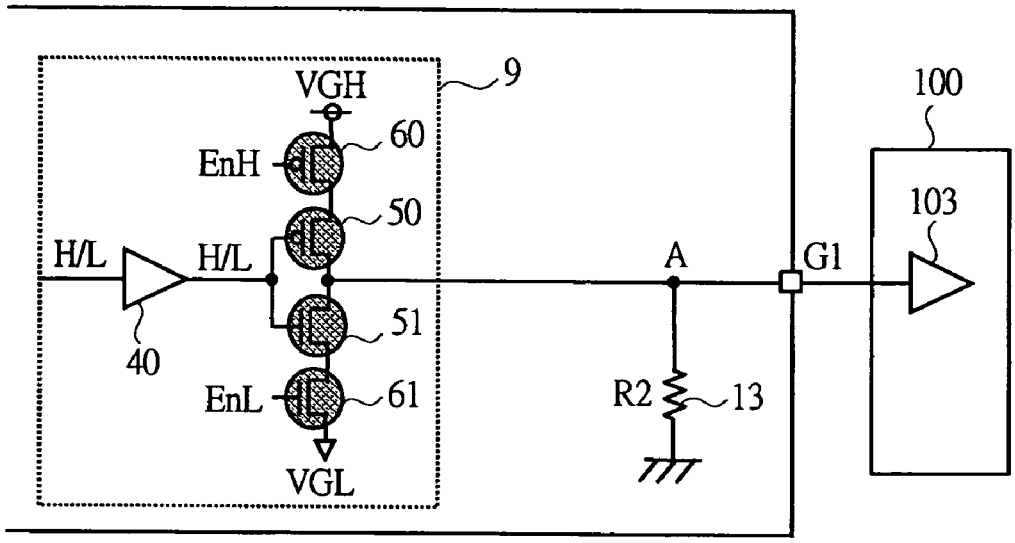
FIG. 10A is a view showing an equivalent circuit at a time of testing in a second embodiment and shows an equivalent circuit when a counter value is "1".
Figure 10B:
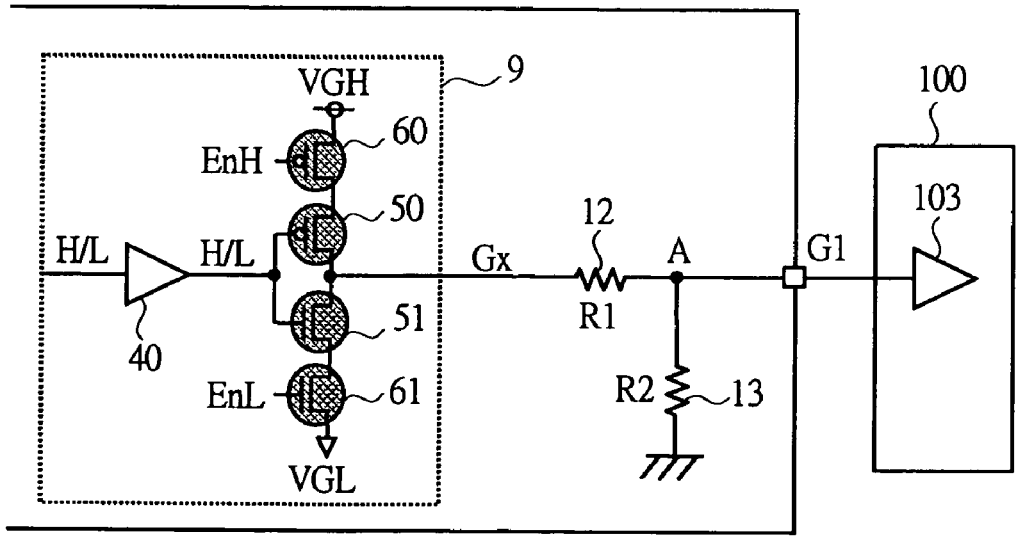
FIG. 10B is a view showing an equivalent circuit at a time of testing in a second embodiment and shows an equivalent circuit when a counter value is other than "1".
Figures 11, 12:
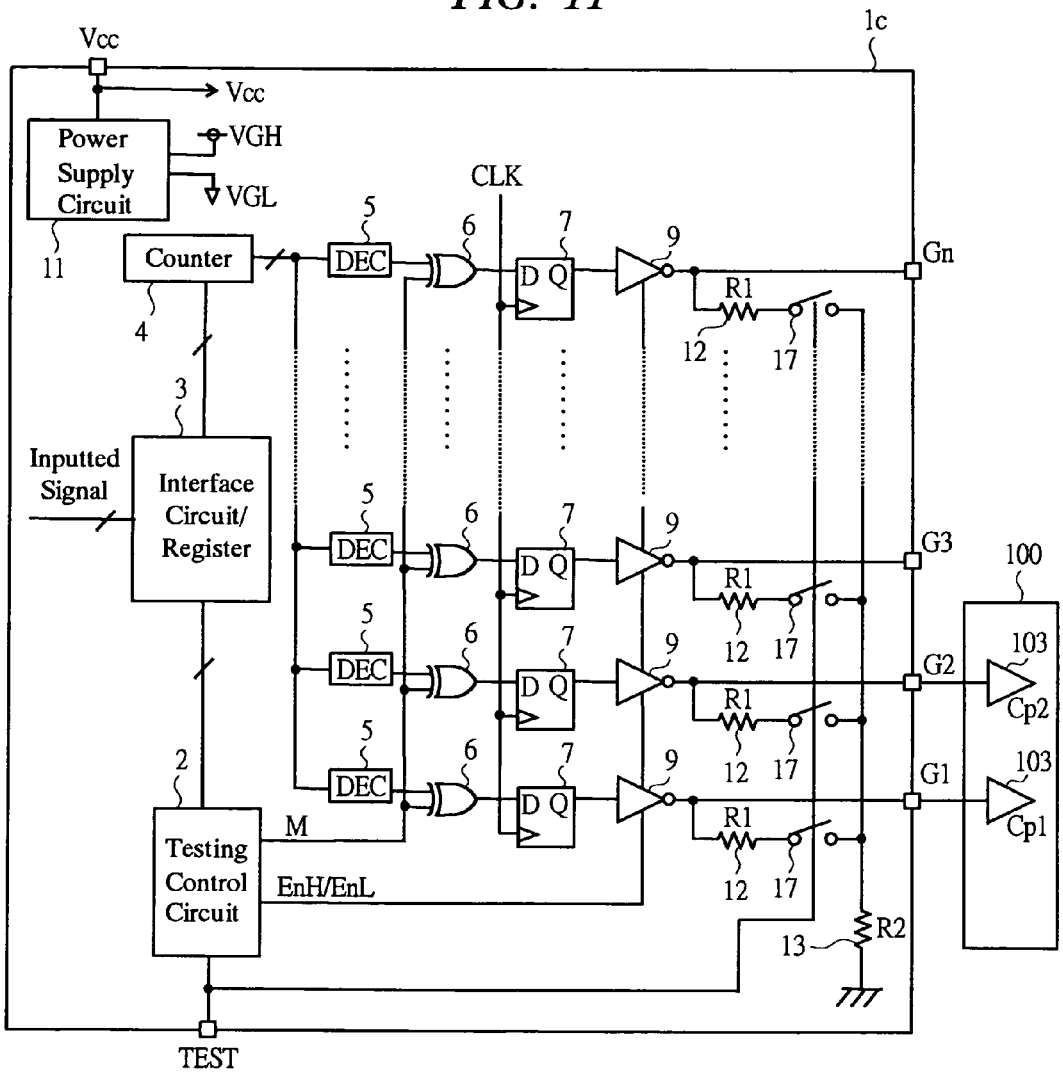
FIG. 11 is a view showing a configuration example of an LCD driver, in which a reference voltage is not required to be reset, in a second embodiment.
FIG. 12 is a view showing a test pattern in a second embodiment.

Specifically, if no failure exists in the LCD driver 1*b*, the equivalent circuit becomes shown in FIG. 10A when the above-described counter value in FIG. 6 is "1" and the equivalent circuit becomes shown in FIG. 10B when the counter value is other than "1". In the first embodiment, if the LCD driver is operated normally, the voltage is consistently fixed to a value determined by a resistance ratio of the first resistor 12 and the second resistor 13 regardless of the counter value. However, in the present embodiment, the output voltage is VGL or VGH only when the counter value is "1" as seen from the equivalent circuit in FIG. 10. The semiconductor test equipment 100 determines whether the voltage value is good or bad. However, by changing the reference voltage of the comparator 103 in the semiconductor test equipment 100 depending on a state in which the counter value of the LCD driver 1*b* is "1" or in which it is other than "1", the test can be accurately conducted. Note that setting of the reference voltage of the comparator 103 can be optionally executed by a program for controlling the semiconductor test equipment 100, i.e., a test program.

Note that the switch 17 as illustrated in this embodiment generally comprises one or more transistors. Although the first resistor 12 and the second resistor 13 are illustrated so as to be integrated together in the LCD driver 1, the second resistor 13 may be modified so as to be connected to the outside without being integrated at the time of the testing.

As having been described thus far, in this embodiment, the voltages to be inputted into the comparator 103 of the semiconductor test equipment 100 are different when the counter value is "1" or when it is other than "1". Similarly to the first embodiment, if the inputted voltage of the comparator 103 is constant regardless of the setting state of the LCD driver 1, it is not required to change the reference voltage of the comparator at the time of the testing. However, in this embodiment, it is necessary to change once the reference voltage of the comparator at the time of the testing. For this reason, the test time is longer than that in the first embodiment since it takes any time to set the reference voltage of the comparator. Accordingly, in the LCD driver 1*b* shown in this embodiment, one example in which the test is conducted without resetting the reference voltage of the comparator 103 is shown in FIG. 11.

In an LCD driver 1*c* as shown in FIG. 11, two comparators (Cp1 and Cp2) 103 of the semiconductor test equipment are used and each of the comparators Cp1 and Cp2 is connected respectively to the gate output terminals G1 and G2 to conduct the test. When the LCD driver 1*c* is set to the test mode (1) and the counter value is "1", the voltage VGH is inputted to the comparator Cp1 connected to the terminal G1 and the voltage VGH/2 is inputted to the comparator Cp2 connected to the terminal G2. Also, when the counter value is "2", the voltage VGH/2 is inputted to the comparator Cp1 connected to the terminal G1 and the voltage VGH is inputted to the comparator Cp2 connected to the terminal G2.

In the above description, a detailed explanation has not been made of determining whether the LCD driver is good or bad by the comparator 103 of the semiconductor test equipment 100. However, whether the LCD driver is good or bad is in fact determined depending on whether test patterns as shown in FIG. 12, i.e., patterns that indicate an expected value H/L outputted from the comparator coincide with each other. In this case, the word "X" described in the test patterns indicates that it does not determine the expected value regardless of the value H/L outputted from the comparator. That is, in the embodiment shown in FIG. 11, the reference voltages of the two comparators Cp1 and Cp2 connected to the gate outputs are set to fixed values in order to expect the value VGH/2, and are employed so as to be determined using the test patterns by the comparator connected to the terminal G2 only when the counter value is "1" and by the comparator connected to the terminal G1 when the counter value is other than "1". For this reason, since resetting the reference voltage of the comparator becomes unnecessary, the test time is shorter than the case as shown in FIG. 7.

Note that although the comparators 103 are connected to the terminals G1 and G2 in FIG. 11, the connecting terminals are not limited to this embodiment, and two comparators may be used to conduct the test. The test pattern as shown in FIG. 12 is represented as one example and is not limited to such a pattern.

In the above-described first and second embodiments, there can be confirmed an exclusive operation, that is, an operation in which only one gate output pin among the plurality of gate output pins outputs a voltage. However, it is difficult to specify which gate output pin among the plurality of gate output pins outputs the voltage. Therefore, in order to conduct a further reliable test, it is preferable to use the following third or fourth embodiment.

Third Embodiment

Figure 13:
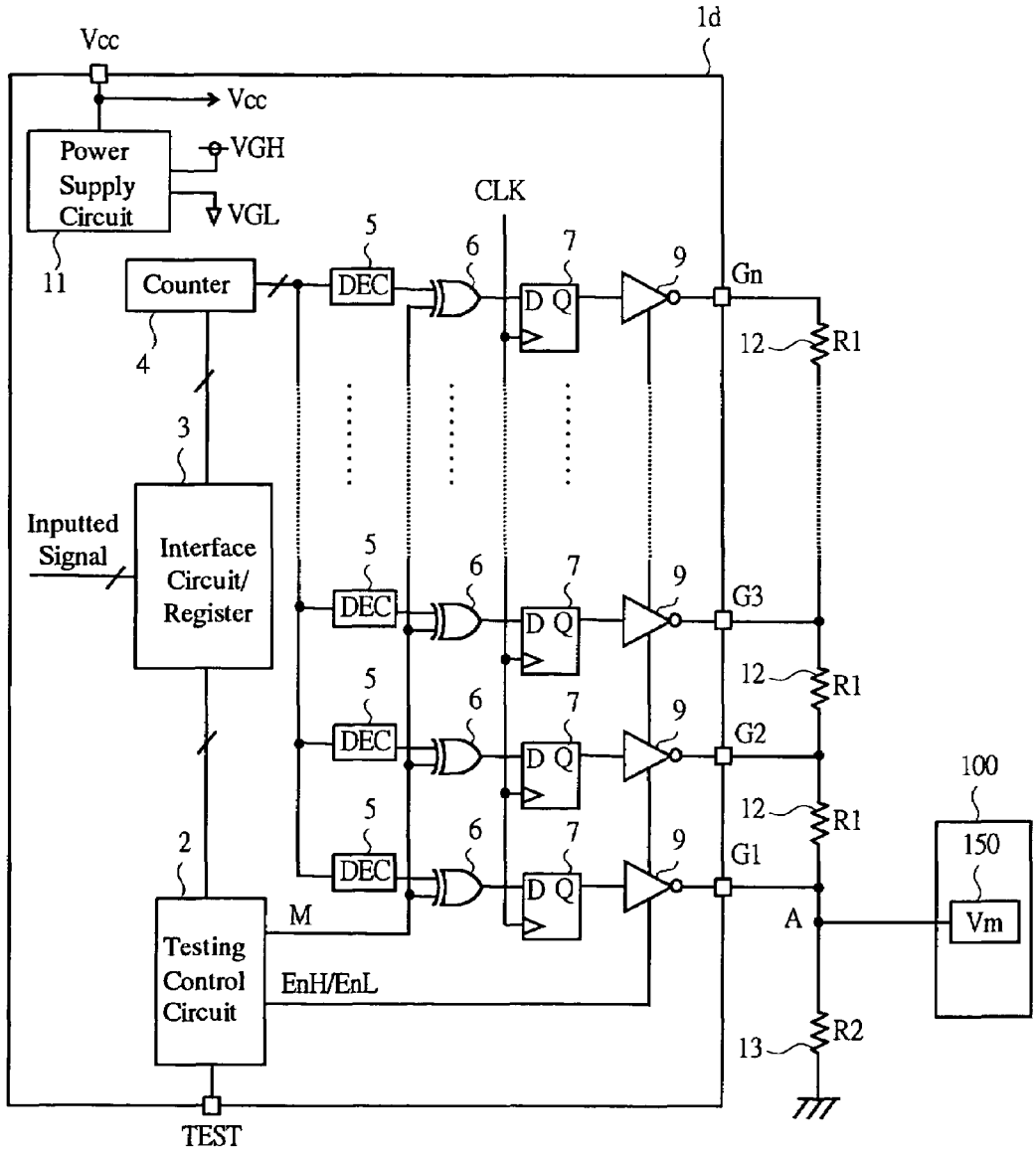
FIG. 13 is a view of a configuration of an LCD driver in a third embodiment.
Figure 14:
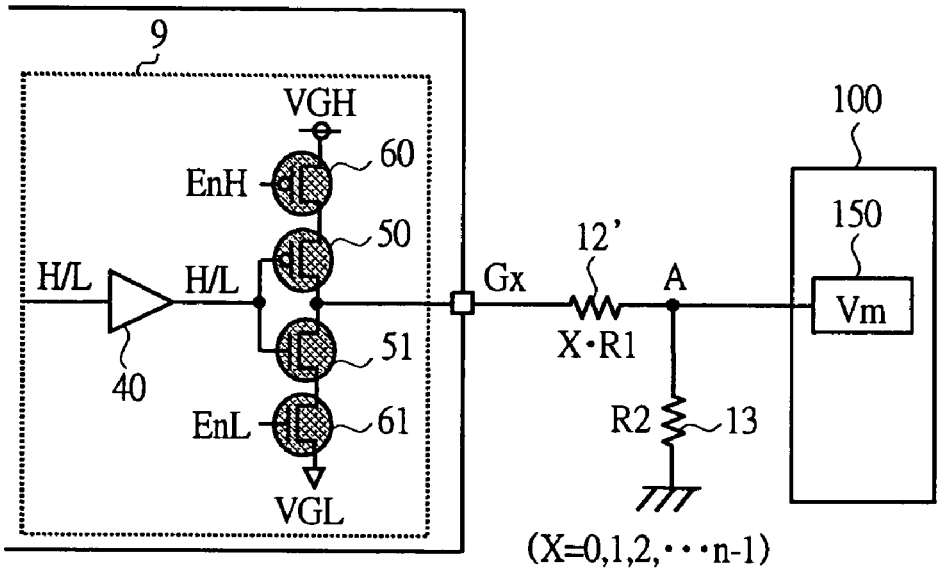
FIG. 14 is a view showing an equivalent circuit at a time of testing in a third embodiment.

An LCD driver, which is a third embodiment of a semiconductor device according to the present invention, will be described using FIGS. 13 and 14. FIG. 13 is a view showing a configuration of an LCD driver; and FIG. 14 is a view showing an equivalent circuit at a time of the testing.

A difference between an LCD driver 1*d* of a third embodiment and the LCD driver of the first embodiment is, as shown in FIG. 13, a configuration of the resistor network provided between the respective gate output terminals G1 to Gn and the semiconductor test equipment 100. Specifically, the first resistors 12 are connected between the respective gate output terminals, and one end (connecting point "A") of the first resistor 12 connected only to the gate output terminal is terminated on the second terminal 13 by connecting the resistor network other than that of the first embodiment, the test mode (1) described in the first embodiment is set to conduct the test.

In this embodiment, the first resistor R1 is weighted, for example as shown in FIG. 6A, so that: the voltage of the connecting point "A" is VGH when the counter value is set to "1"; it is a voltage divided by the first resistor R1 and the second resistor R2 when the counter value is set to "2"; it is a voltage divided by the double first resistor 2R1 and the second resistor R2 when the counter value is set to "3"; and the like. The equivalent circuit in this case is shown in FIG. 14 and the voltage of the connecting point "A" is represented by the following formula:

$$VA=\{R2/(xR1+R2)\}VGH[V] \quad \text{(formula 3)}$$

(wherein x: "counter value"−1).

Thereby, the gate voltage output pin can concurrently be determined in accordance with the voltage value at the connecting point "A".

Additionally, even in this embodiment, the test mode (2) as shown in FIG. 4 is set similarly to the first embodiment to conduct the test in a similar manner. Note that if the outputted voltage is not changed to the state as shown in FIG. 6 at the time of the testing due to any failure, it is necessary to examine the equivalent circuit as described in the above first embodiment. By such an examination, it is apparent that the voltage value at the connecting point "A" is different from the expected value and presence or absence of any failure can be determined.

The voltage at the connecting point "A" is measured by a voltage measurement unit 150 of the semiconductor test equipment 100, as shown in FIG. 13. The voltage measurement may be performed using the comparator of the semiconductor test equipment 100 similarly to the first embodiment. However, it takes generally about several tens ms for the semiconductor test equipment 100 to set the reference value of the comparator. Since the voltage measurement unit 150 of the semiconductor test equipment 100 measures a voltage and determines it by an evaluation value previously written on the test program, determination speed depends on the CPU etc. of the semiconductor test equipment. Therefore, the high-speed determination can be made. In the case where the voltage is changed per measurement similarly to this embodiment, as shown in FIG. 13, the use of the voltage measurement unit 150 is more suitable because the test time is shortened and the production cost for the LCD driver 1*d* can be reduced.

However, this embodiment is not limited to the voltage measurement unit 150 of the semiconductor test equipment 100, and any optical method of conducting the test may be applied.

Fourth Embodiment

Figure 15:
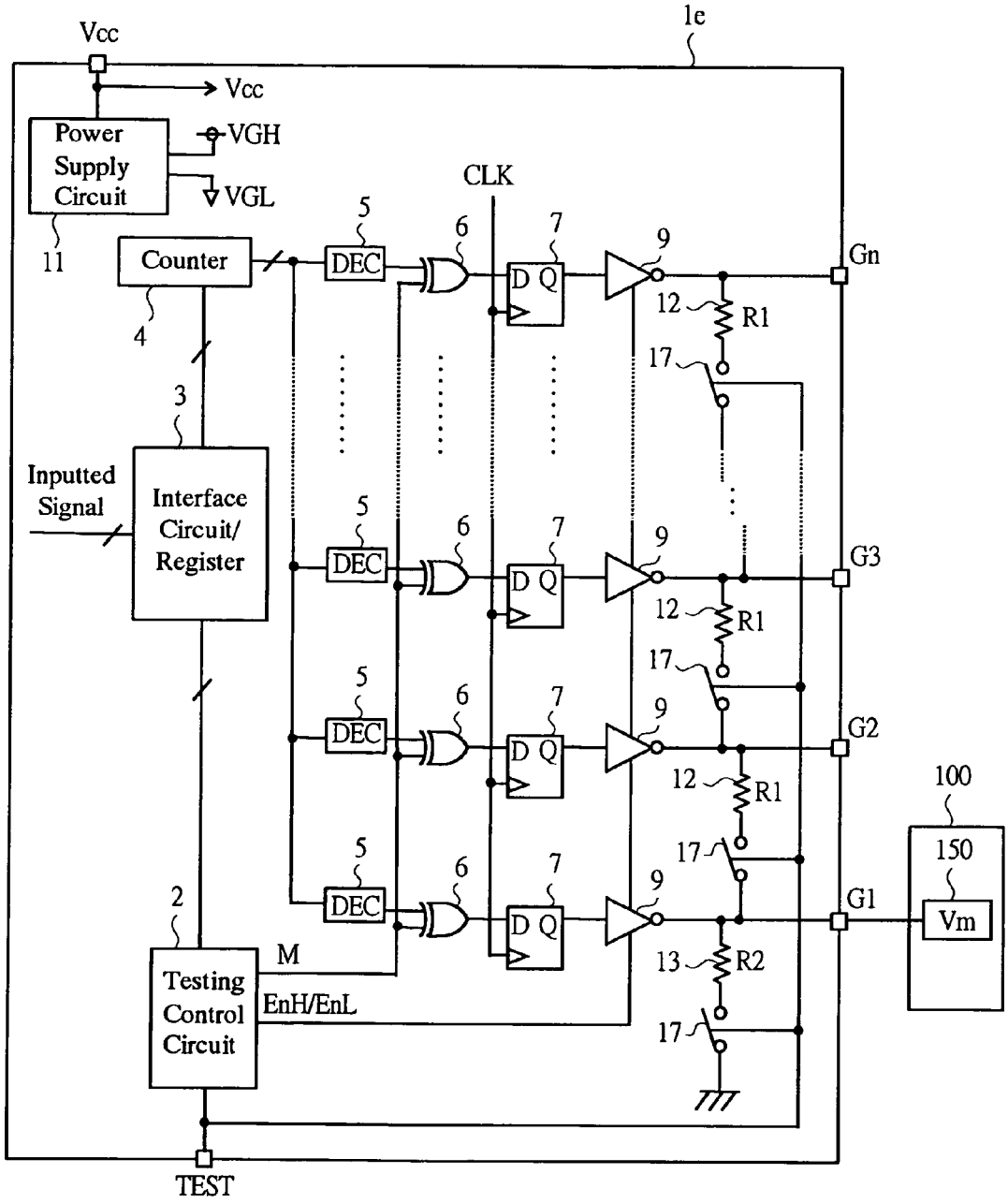
FIG. 15 is a view showing a configuration of an LCD driver in a fourth embodiment.

An LCD driver, which is a fourth embodiment of a semiconductor device according to the present invention, will be described using FIG. 15. FIG. 15 is a view showing a configuration of an LCD driver.

An LCD driver 1*e* of a fourth embodiment is, as shown in FIG. 15, one example in which the resistor network of the third embodiment is integrated into the LCD driver 1 and the switch 17 connected to the first resistor 12 in series is provided so as to separate the resistor network except setting of the test modes at the time of conducting the test. A concrete operation and a testing method are not described because these are the same as the third embodiment. The same effects can be obtained also from this embodiment.

Note that the switch 17 illustrated in this embodiment comprises one or more transistors similarly to the second embodiment. Further, although the first resistor 12 and the second resistor 13 are illustrated so as to be integrated together in the LCD driver 1, the second transistor 13 may be modified so as to be connected to the outside at the time of the testing without being integrated.

Fifth Embodiment

An LCD driver, which is a fifth embodiment according to the present invention, will be described using FIGS. 1 and 20. FIG. 1 is a view showing a configuration of an LCD driver; and FIG. 20 is a view showing a circuit configuration of the inverter circuit 9 in FIG. 1.

Figure 20:
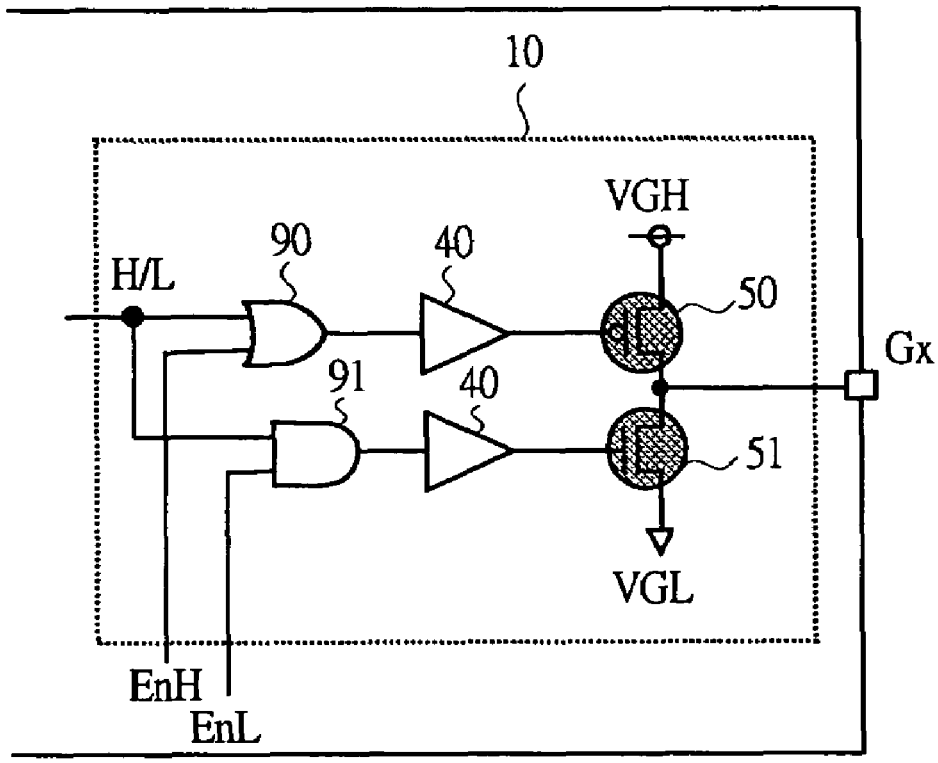
FIG. 20 is a view showing a configuration of an inverter circuit in a fifth embodiment.

An LCD driver 1 of a fifth embodiment is a modified example in which the configuration (FIG. 2) of the inverter circuit 9 described in the first embodiment is changed to the circuit configuration 10 shown in FIG. 20.

Specifically, similarly to the first embodiment, when the test modes as shown in FIG. 4 are set, the inputted levels (H/L) into the gates of the p-channel transistor 50 and the n-channel transistor 51 are controlled by an OR circuit 90 and an AND circuit 91 in accordance with the levels inputted into the inverter circuit 9. Therefore, the change and control to the high-impedance state can be executed depending on the inputted levels similar to the first embodiment. Hereinafter, the concrete testing method is omitted because it is the same as the first embodiment.

According to this embodiment, since the OR circuit 90 and the AND circuit 91 for change and control to the high-impedance states are disposed at the previous stages of the level shift circuits 40, it becomes unnecessary to employ the high-voltage transistors similarly to the high-impedance control transistor in the first embodiment. Also, in the circuit configuration as shown in FIG. 2 of the first embodiment, an on-resistance (output impedance) value in terms of the gate terminal corresponds to the sum of the p-channel transistors 50 and 60 or the sum of the n-channel transistors 51 and 61. However, in this embodiment, the on-resistance value corresponds to a resistance value of the p-channel transistor 50 or n-channel transistor 51 similarly to the conventional LCD driver, so that if the p-channel transistor 50 and the n-channel transistor 51 having the same characteristics as those of the first embodiment are used, the value of the on-resistance of the gate terminal can be further decreased.

The foregoing description has been made on the premise that the inverter circuit of the fifth embodiment is applied to the first embodiment (FIG. 1). However, it is apparent from the descriptions of the above second to fourth embodiments that the inverter circuit of the fifth embodiment can be applied also to the second to fourth embodiments (FIGS. 9, 11, 13, and 15). Further, the same effects can be obtained also from this embodiment.

In this embodiment, the case where the OR-circuit 90 and the AND circuit 91 are used as a means for controlling the levels inputted into the gates of the p-channel transistor 50 and the n-channel transistor 51 and for changing to a high-impedance state has been described. However, the present invention is not limited to such a circuit configuration, and so long as other configurations can similarly control the gate levels of the p-channel transistor 50 and the n-channel transistor 51, they may be applied.

In the above-mentioned descriptions, the invention made by the present inventors has been specifically detailed based on the embodiments. However, needless to say, the present invention is not limited to the above embodiments, and can be variously modified and altered without departing from the gist thereof.

What is claimed is:

1. A semiconductor device having a function of driving a gate line of a liquid crystal display panel, the device comprising:

a polarity inverting circuit for inverting polarities of a positive voltage and a negative voltage for driving said gate line;

a state setting circuit capable of changing and controlling, to a high-impedance state, an output circuit for driving said gate line; and at least one control terminal for controlling states of said polarity inverting circuit and said state setting circuit, wherein an inside or outside of the semiconductor device is provided with:

a resistor network or a portion of said resistor network changing and controlling, to a positive voltage output and a high-impedance state or to a negative voltage output and a high-impedance state, outputs of a plurality of output terminals each driving said gate line; and a switch means capable of separating said resistor network or the portion of said resistor network at a time of an normal operation.

2. The semiconductor device according to claim 1, further comprising:

a control circuit connected to said at least one control terminal and controlling the states of said polarity inverting circuit and said state setting circuit.

3. The semiconductor device according to claim 1, wherein said resistor network connects one end of a first resistor to each output terminal of the output circuit for driving the gate line of said liquid crystal display panel, connects the other end of said first resistor to a common connecting point and terminates said common connecting point one second resistor.

4. The semiconductor device according to claim 1, wherein said resistor network connects a first resistor between respective output terminals of the output circuit for driving the gate line of said liquid crystal display panel, and terminates, on the second resistance, one of both ends of the first resistance In which the one end of the first resistance connected between said respective output terminais is connected only to said output terminal.

5. A semiconductor device according to claim 1 for driving a liquid crystal display panel, further comprising:

a plurality of said state setting circuits each having a signal input terminal, connecting a gate terminal of a first p-channel transistor and a gate terminal of a first n-channel transistor, and an output terminal connecting a drain terminal of said first p-channel transistor and a drain terminal of said first n-channel transistor, said state setting circuits each connecting a drain terminal of a second p-channel transistor to a source terminal of said first p-channel transistor, connecting a drain terminal of a second n-channel transistor to a source terminal of said first n-channel transistor, connecting source terminals of said second p-channel and n- channel transistors to a positive or negative voltage, and including a control terminal for independently controlling levels of gate terminals of said second p-channel and n-channel transistors.

6. The semiconductor device according to claim 5, further comprising a control circuit for controlling the gate terminals of said second p-channel and n-channel transistors and the polarity inverting circuit.

7. A semiconductor device according to claim 1 for driving a liquid crystal display panel, further comprising:

a plurality of said state setting circuits each connecting source terminals of p-channel and n-channel transistors to a positive or negative voltage and having an output terminal connecting a drain terminal of said p-channel transistor and a drain terminal of said n-channel transistor, the state setting circuits each connecting first and second logic circuits to gate terminals of said p-channels and n-channel transistors and each being capable of switching arbitrarily an on-operation of one of said p-channel and n-channel transistors to invalidation according to input signals of said first and second logic circuits and a control signal.

8. The semiconductor device according to claim 7, further comprising:

a control circuit for controlling control signals of the logic circuits and a polarity inverting circuit provided in a previous stage of each of said state setting circuits.

9. A method of testing a semiconductor device having a function of driving a gate line of a liquid crystal display panel, the method comprising the steps of:

changing and controlling, to a positive voltage output and a high-impedance state or to a negative voltage output and a high-impedance state, outputs of a plurality of output terminals for driving said gate line; and conducting a test of the plurality of output terminals of said semiconductor device, through a resistor network provided inside or outside said semiconductor device, by less channels of a semiconductor test equipment in number than the output terminals of said semiconductor device wherein the resistor network provided inside or outside said semiconductor device connects one end of a first resistor to each output terminal of the output circuits for driving the gate line of said liquid crystal display panel, connects the other end of said first resistor to a common connection point, and terminates said common connecting point on a second resistor to determine whether said semiconductor device is good or bad in accordance with a voltage value at said common connecting point.

10. A method of testing a semiconductor device having a function of driving a gate line of a liquid crystal display panel, the method comprising the step of:

conducting, through a resistor network provided inside or outside the semiconductor device according to claim 9, a test of a plurality of output terminals of said semiconductor device by less channels of a semiconductor test equipment in number than the output terminals of said semiconductor device.

11. A method of testing a semiconductor device having a function of driving a gate line of a liquid crystal display panel, the method comprising the steps of:

changing and controlling, to a positive voltage output and a high-impedance state or to a negative voltage output and a high-impedance state, outputs of a plurality of output terminals for driving said gate line; and conducting a test of the plurality of output terminals of said semiconductor device, through a resistor network provided inside or outside said semiconductor device, by less channels of a semiconductor test equipment in number than the output terminals of said semiconductor device wherein the resistor network provided inside or outside said semiconductor device connects a first resistor between respective output terminals of the output circuits for driving the gate line of said liquid crystal display panel, and terminates, on a second resistor, one of both ends of the first resistor in which the one end of the first resistance connected between the respective output terminals is connected only to said output terminal to determine whether said semiconductor device is good or bad in accordance with a voltage value at a common connecting point of said first and second resistors.

12. A method of testing a semiconductor device having a function of driving a gate line of a liquid crystal display panel, the method comprising the step of:

conducting, through a resistor network provided inside or outside the semiconductor device according to claim 11, a test of a plurality of output terminals of said semiconductor device by less channels of a semiconductor test equipment in number than the output terminals of said semiconductor device.

* * * * *